US007740165B2

(12) United States Patent
Tackett

(10) Patent No.: US 7,740,165 B2
(45) Date of Patent: Jun. 22, 2010

(54) MAGNETIC MAIL NOTIFICATION APPARATUS

(75) Inventor: Shelby G. Tackett, Garland, TX (US)

(73) Assignee: C&S Innovations, Garland, TX (US)

( * ) Notice: Subject to any disclaimer, the term of this patent is extended or adjusted under 35 U.S.C. 154(b) by 0 days.

(21) Appl. No.: 11/940,811

(22) Filed: Nov. 15, 2007

(65) Prior Publication Data

US 2009/0127324 A1 May 21, 2009

(51) Int. Cl.
*A47G 29/14* (2006.01)

(52) U.S. Cl. ..... 232/35

(58) Field of Classification Search ..... 232/35, 232/17; 116/204; D99/29, 31, 43
See application file for complete search history.

(56) References Cited

U.S. PATENT DOCUMENTS 3,080,107 A * 3/1963 Lindahl ..... 232/35
3,675,845 A * 7/1972 Scheerer ..... 232/35
6,155,482 A * 12/2000 Perry ..... 232/35
7,337,945 B1 * 3/2008 Riggs et al. ..... 232/35

OTHER PUBLICATIONS

SmartHome, "Home Automation Superstore," dated Jul. 31, 2007.
Topper's Place, "Save-a-Step," dated Jul. 19, 2007.
Mailboxixchange, "4B Standard Horizontal Mailboxes," Jul. 26, 2007.
"Mahvelous" Mailboxes and More. "Mail Time Mail Alert," dated Jul. 19, 2007.
"Mahvelous" Mailboxes and More. "Y'all Got Mail Alert," dated Jul. 19, 2007.
"Mahvelous" Mailboxes and More, "French Mail Alert," dated Jul. 29, 2007.
"Mahvelous" Mailboxes and More, "Red Flip Flag Mail Is Here Signal," dated Jul. 29, 2007.
Ebay, "Mail Is Here Rural Mailbox Notification Alert Star," dated Jul. 28, 2007.
Amazon, "Mail Alert," dated 1996-2007.

* cited by examiner

*Primary Examiner*—William L. Miller
(74) *Attorney, Agent, or Firm*—Smith IP Services, P.C.

(57) ABSTRACT

Magnetic mail notification apparatus. Apparatus for use with a mailbox having a door pivotably attached to a mail receptacle includes an indicator assembly including an indicator arm positionable in one position when the door is closed, and a magnetic coupling between the door and the indicator arm, the magnetic coupling displacing the indicator arm to another position when the door is opened. Another apparatus includes the indicator arm positionable in one position when the door is closed and in another position when the door is opened, and a magnet holding the indicator arm in the first position until the door is opened, and causing the indicator arm to displace to the second position when the door is opened. Another apparatus includes a base assembly securable to the mail receptacle, an indicator assembly pivotably attached to the base assembly, and a magnetic coupling between the base assembly and the indicator arm.

8 Claims, 5 Drawing Sheets

FIG. 1
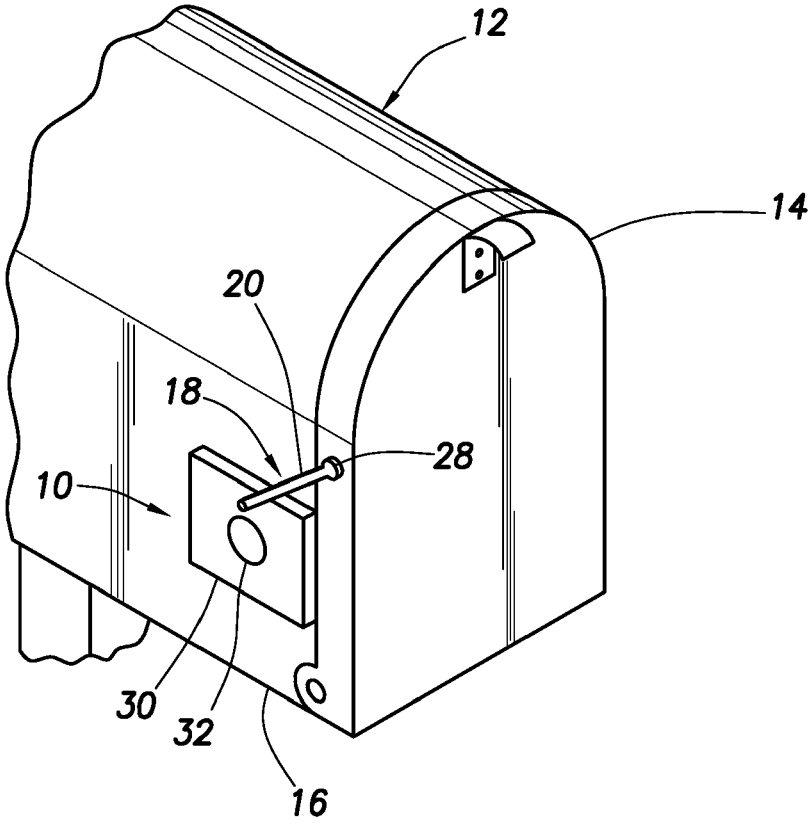
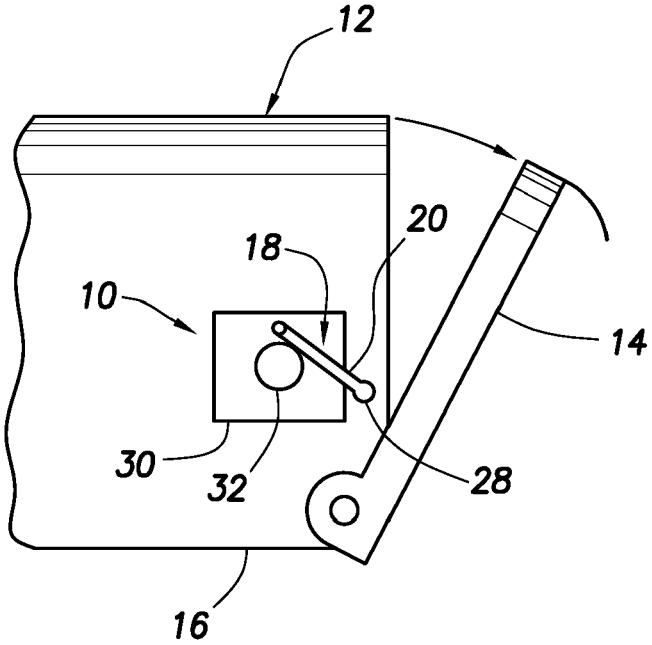
FIG. 2

FIG.3
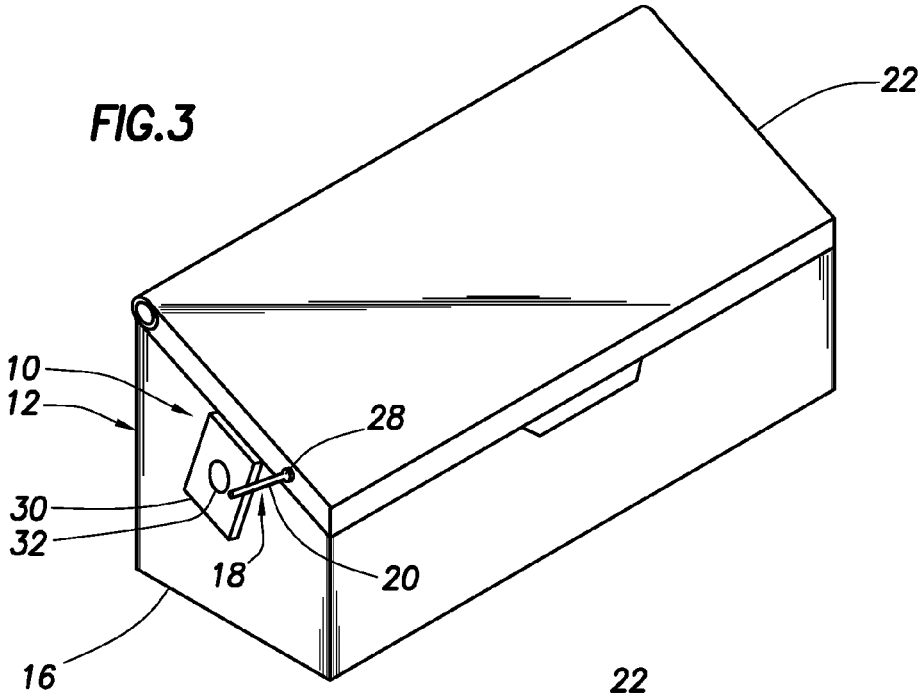
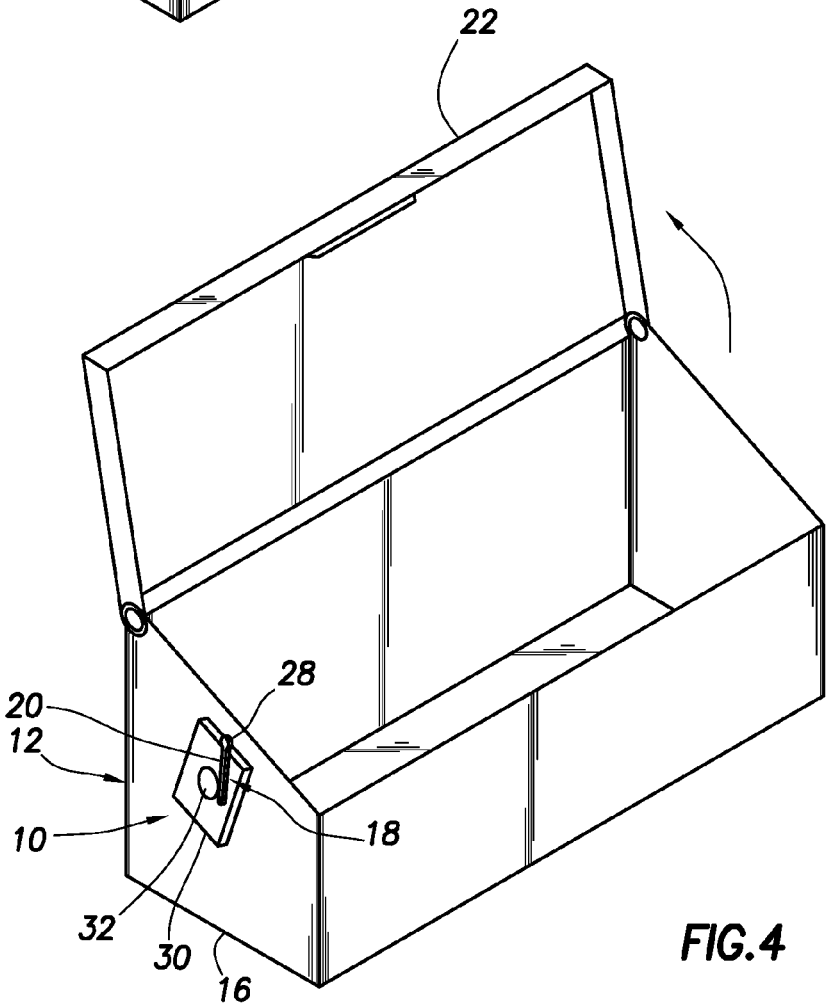
FIG.4

FIG.8
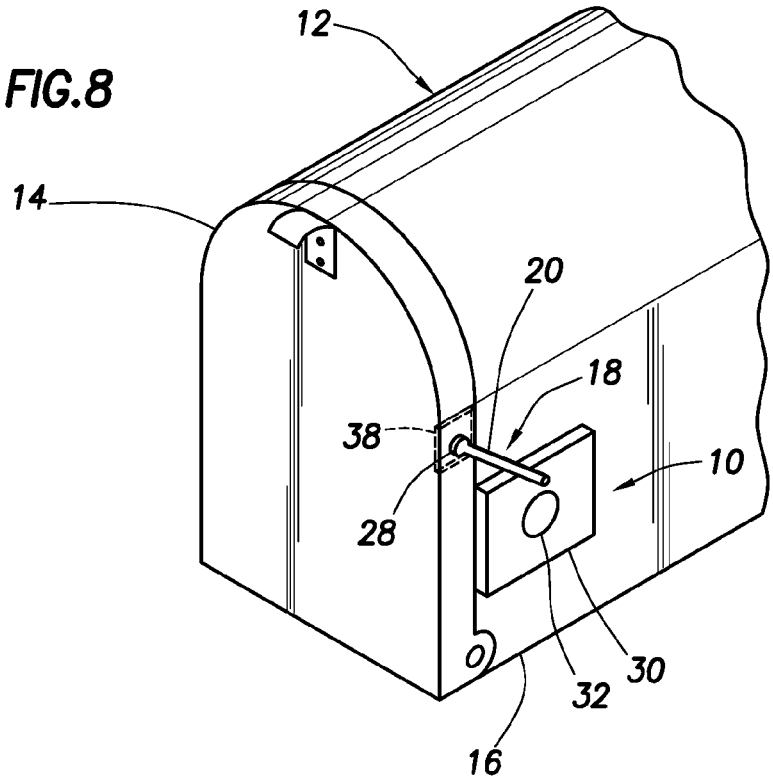
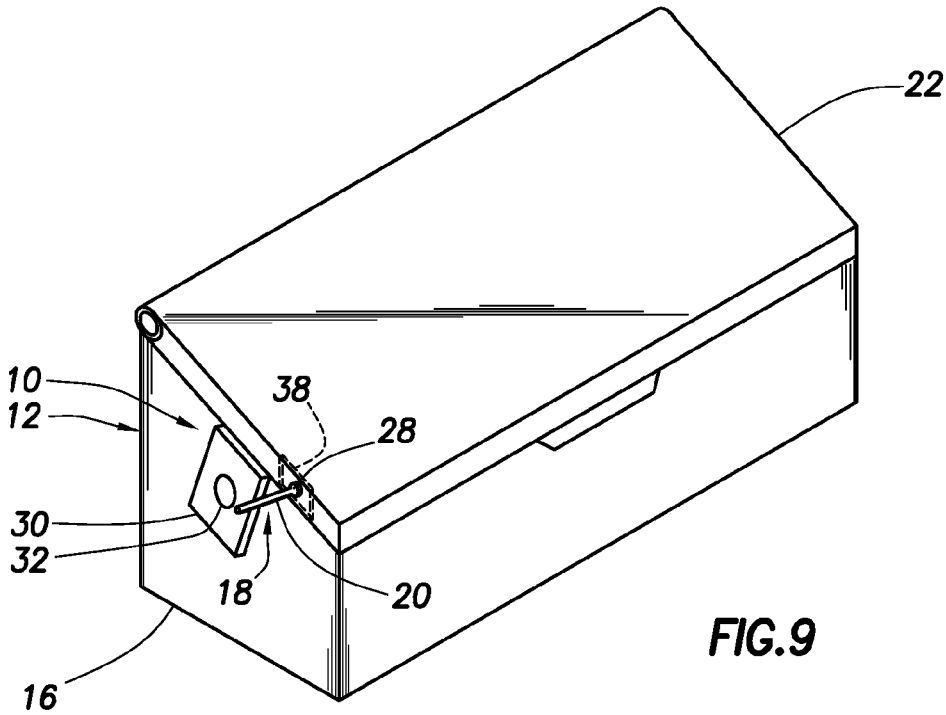
FIG.9

MAGNETIC MAIL NOTIFICATION APPARATUS

BACKGROUND

The present invention relates generally to mail notification systems and, in an embodiment described herein, more particularly provides a magnetic mail notification apparatus.

Everyday, sometimes multiple times a day, people check their mailboxes unsure of whether or not they will find a delivery or an empty box. Until the moment the mail has been delivered, multiple trips to the mailbox can result in wasted time and energy.

In addition to wasted time, hazards may arise while checking the mail, particularly during inclement weather. When slippery conditions exist, such as due to the presence ice or rain, injuries may be incurred en route to retrieve mail from the mailbox. The effects of these hazards can severely impact a person's lifestyle, especially for the elderly and handicapped. The loss of time and exposure to danger can be compounded in rural areas where the mailbox is typically located beside a road with no sidewalk access, a far distance away from the home.

Unfortunately, the typical mail alert device is difficult to install and may include battery operation and spring loads that must be continuously set and reset manually. These devices are expensive and include complicated operation and installation methods.

Therefore it may be seen that improvements are needed in the art of mail notification. It is among the objects of the present invention to provide such improvements.

SUMMARY

In the present specification, a magnetic mailbox notification apparatus is provided which solves at least one problem in the art. One example is described below in which the apparatus provides an indication of whether a mailbox door has been opened. Another example is described below in which the apparatus is conveniently attachable to the mailbox.

In one aspect, an apparatus for use with a mailbox having a door pivotably attached to a mail receptacle is provided. The apparatus includes an indicator assembly including an indicator arm positionable in a first position when the door is closed, and a magnetic coupling between the door and the indicator arm. The magnetic coupling is operative to displace the indicator arm to a second position when the door is opened.

In another aspect, an apparatus is provided which includes an indicator assembly with an indicator arm positionable in a first position when the door is closed and in a second position when the door is opened. A magnet holds the indicator arm in the first position until the door is opened, and holds the indicator arm in the second position after the door is opened.

In yet another aspect, an apparatus is provided which includes a base assembly securable to the mail receptacle, an indicator assembly pivotably attached to the base assembly and including an indicator arm, and a magnetic coupling between the base assembly and the indicator arm.

Inconvenience, aggravation, exposure to hazards, in addition to wasted time and energy, can be circumvented with the mail notification apparatus. The apparatus adheres directly to the mailbox, preferably with no tools required, and provides a magnetic coupling that is instantly engaged. After a quick and easy installation, by simply glancing at the mailbox, one will know in seconds whether or not the mail has arrived, or if items to be mailed have been picked up by the letter carrier.

These and other features, advantages, benefits and objects will become apparent to one of ordinary skill in the art upon careful consideration of the detailed description of representative embodiments of the invention hereinbelow and the accompanying drawings, in which similar elements are indicated in the various figures using the same reference numbers.

BRIEF DESCRIPTION OF THE DRAWINGS

FIG. 1 is an isometric view of a magnetic mailbox notification apparatus as used with a closed mailbox door, the apparatus embodying principles of the present invention;

FIG. 2 is a side view of the apparatus as used with an open mailbox door;

FIG. 3 is an isometric view of the apparatus as used with a closed mailbox lid;

FIG. 4 is an isometric view of the apparatus as used with an open mailbox lid;

FIG. 8 is a isometric view of the apparatus as used with a non-magnetic mailbox door, and including an additional magnet;

FIG. 9 is an isometric view of the apparatus as used with a non-magnetic mailbox lid, and including an additional magnet.

DETAILED DESCRIPTION

Figure 5:
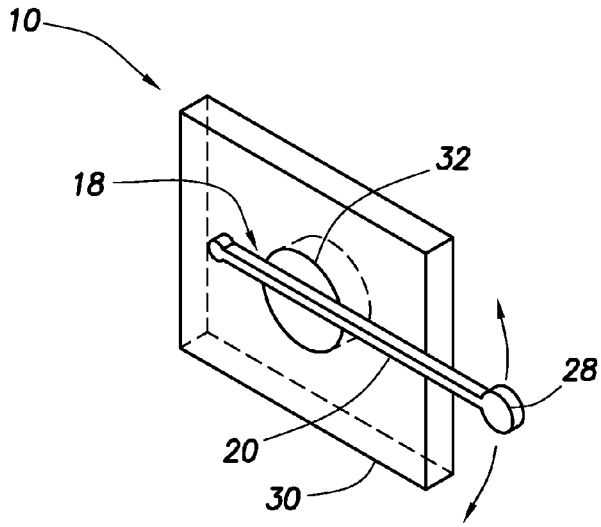
FIG. 5 is an enlarged schematic isometric view of the apparatus.

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

Representatively illustrated in FIGS. 1-4 is an apparatus 10, which embodies principles of the present invention. The apparatus 10 is used in conjunction with a mailbox 12. As depicted in FIGS. 1 & 2, the mailbox 12 includes a one-piece curved top and side walls, a one-piece bottom and a closed rear panel defining a mail receptacle 16. A door 14 is hingedly attached to the bottom of the mailbox 12 for access to the receptacle 16.

The apparatus 10 includes a base assembly 30 and an indicator assembly 18. The base assembly 30 is generally planar, with one side which attaches to the mail receptacle 16 and an opposite side that forms a magnetic coupling with an indicator arm 20 of the indicator assembly 18. The indicator arm 20 is pivotably attached to the base assembly 30.

Furthermore, attached to a distal end of the indicator arm 20 is a magnet 28 having a magnetic coupling with the door 14 of the mailbox 12.

In a preferred embodiment, the base assembly 30 of the apparatus 10 adheres to the metal mail receptacle 16 by means of a magnet 32 that is inset within the base assembly 30. When attached to the side of the receptacle 16, the magnet 32 is downwardly disposed relative to the pivot connection between the indicator arm 20 and the base assembly 30 in the embodiment of FIGS. 1 & 2.

An adhesive, such as double-stick tape, may alternatively, or in addition, be used to adhere the base assembly 30 to the receptacle 16. Such adhesive may be particularly useful if the receptacle 16 is made of a non-magnetic material.

The magnet 28 that is located on the end of the indicator arm 20 is then positioned in a first position as shown in FIG. 1. The first position allows for a magnetic coupling to take place between the indicator assembly 18 and the door 14.

When the door 14 is closed, the magnet 28 is magnetically attracted to the metal door 14. When the door 14 is opened (e.g., when mail is placed in the receptacle 16), the magnetic attraction between the magnet 28 and the door 14 causes the indicator arm 20 to pivot downward to a second position (as depicted in FIG. 2), allowing for a visual indication of whether the door has been opened.

In this example, the magnet 28 magnetically disengages from the door 14 when it is fully opened, but in other embodiments, the magnet 28 may not magnetically disengage from the door 14. In any event, once the indicator arm 20 has pivoted downward, a magnetic coupling between the indicator arm and the magnet 32 in the base assembly 30 holds the indicator arm in its downwardly pivoted position, even after the door 14 is closed.

Thus, the downwardly pivoted position of the indicator arm 20 gives a visual indication to the user that the door 14 has been opened. The user can reset the indicator arm 20 to its initial upwardly pivoted position (as depicted in FIG. 1) upon retrieving the mail from the receptacle 16.

Still referring to FIGS. 1 & 2, the base assembly 30 should be appropriately sized width-wise to allow for placement on the side of the mailbox 12, especially when used in conjunction with a mailbox that has been pre-fabricated to fit within a freestanding brick mailbox housing. The magnet 32 should be inset away from the edges of the base assembly 30 so that the base assembly 30 is sufficiently anchored to the mail receptacle 16.

The indicator arm 20 of the indicator assembly 18 should be long enough to create a magnetic coupling between the arm and the base assembly 30. The indicator arm 20 should also be long enough to provide a magnetic coupling between the magnet 28 and the door 14 of the mailbox 12. The magnet 28 should be large enough to create a magnetic coupling with the closed door 14 so that it will not be displaced from a first position by the elements such as wind or rain. Note that the apparatus 10 may have other shapes and sizes, and may have other means of providing an adhesion between the base assembly 30 and the mail receptacle 16.

The base assembly 30 is preferably made of weatherproof plastic material, but can be made from any non-magnetic material, such as wood, rubber, glass, aluminum, etc. The magnet 32 is preferably medially positioned within the base assembly 30, so as to provide a stable adhesive force with the mail receptacle 16.

The indicator arm 20 of the indicator assembly 18 may be made of magnetic material so as to provide a magnetic coupling with the magnet 32 of the base assembly 30. The indicator arm 20 may be made of any material with magnetic properties, such as ferrous metal, steel, etc. The magnet 28 is preferably approximately the size of a small pebble, and is placed at the end of the indicator arm 20, in order to form a magnetic coupling with the door 14 of the mailbox 12. However, it should be understood that the various components of the indicator assembly 18 and base assembly 30 can be made of different materials, if desired.

In another configuration, referring to FIGS. 3 & 4, if the apparatus 10 is to be used with a mailbox 12 having a lid 22 hingedly attached to the top of a mail receptacle 16, the apparatus 10 operates in much the same manner. Note that the lid 22 is another type of door for which the apparatus 10 may be used.

The base assembly 30 of the apparatus 10 adheres to the mail receptacle 16 by means of a magnet 32 that is inset within the base assembly 30. The magnet 28 that is located on the end of the indicator arm 20 is then positioned in a first forwardly pivoted position. The first position allows for a magnetic coupling to take place between the indicator assembly 18 and the lid 22. When the lid 22 is closed, the magnet 28 is magnetically attracted to the lid, represented by magnet 28 being forwardly positioned toward the edge of the lid 22.

When the lid 22 is opened (e.g., when mail is placed in the mail receptacle 16), the magnetic coupling between the magnet 28 and the lid 22 causes the indicator arm 20 to pivot rearward to a second position, allowing for a visual indication that the lid has been opened. Note that, in this example, the magnet 28 magnetically disengages from the lid 22 when it is opened (as depicted in FIG. 4), but in other embodiments the magnet 28 may not magnetically disengage from the lid 22. In any event, once the indicator arm 20 has pivoted rearward, a magnetic coupling between the indicator arm and the magnet 32 in the base assembly 30 holds the indicator arm in its rearwardly pivoted position, even after the lid 22 is closed.

Thus, the rearwardly pivoted position of the indicator arm 20 gives a visual indication to the user that the lid 22 has been opened. The user can reset the indicator arm 20 to its initial forwardly pivoted position (as depicted in FIG. 3) upon retrieving the mail from the receptacle 16.

Figure 7:
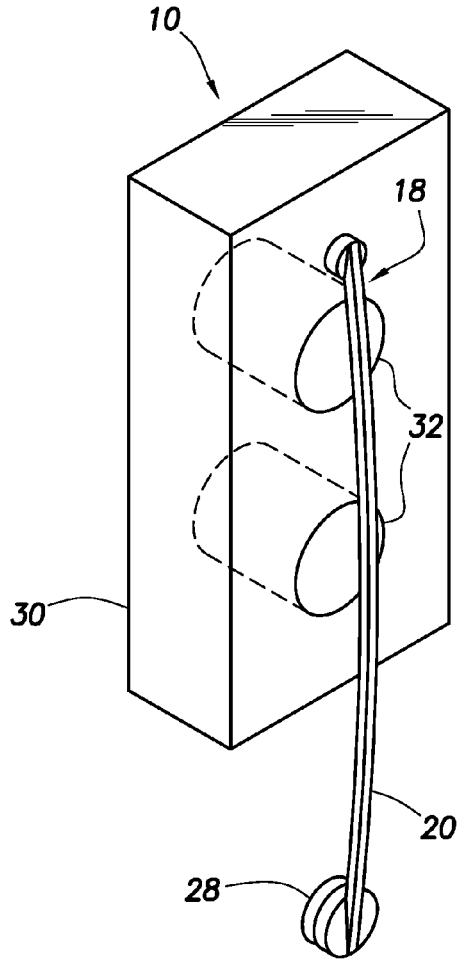
FIG. 7 is an enlarged scale isometric view of the apparatus alternatively fitted with multiple magnets inset in the base of the apparatus.
Figure 6:
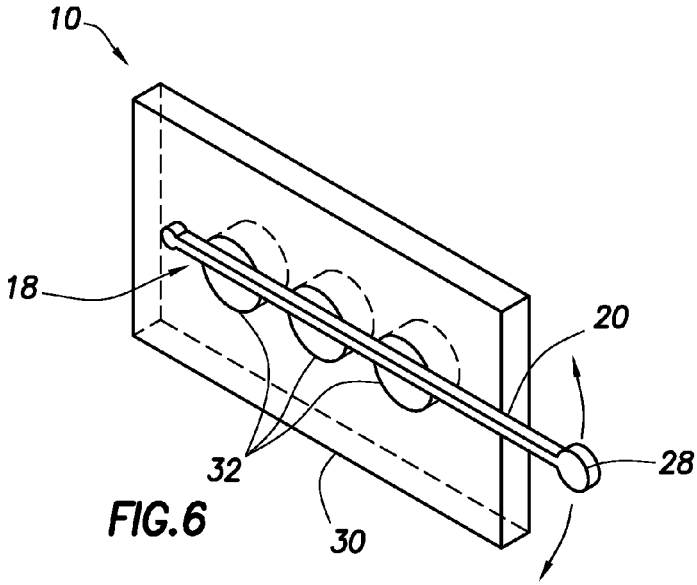
FIG. 6 is an enlarged schematic isometric view of the apparatus alternatively fitted with multiple magnets inset in a base of the apparatus.

In other configurations, referring to FIGS. 6 & 7, additional magnets 32 may be included in the apparatus 10, so that the base assembly 30 may be evenly anchored to the mail receptacle 16, and to provide additional magnetic coupling with the indicator arm 20.

In yet another configuration, referring to FIGS. 8 & 9, if the apparatus 10 is to be used with a non-metal mailbox 12, i.e. made of plastic, wood, or other non-magnetic materials, then magnetic attraction between the base assembly 30 and the mail receptacle 16 will be non-existent. In this case, a double-sided adhesive strip or equivalent may be attached to the posterior side of the base assembly 30 in order to adhere the apparatus 10 to the mail receptacle 16.

Figure 10:
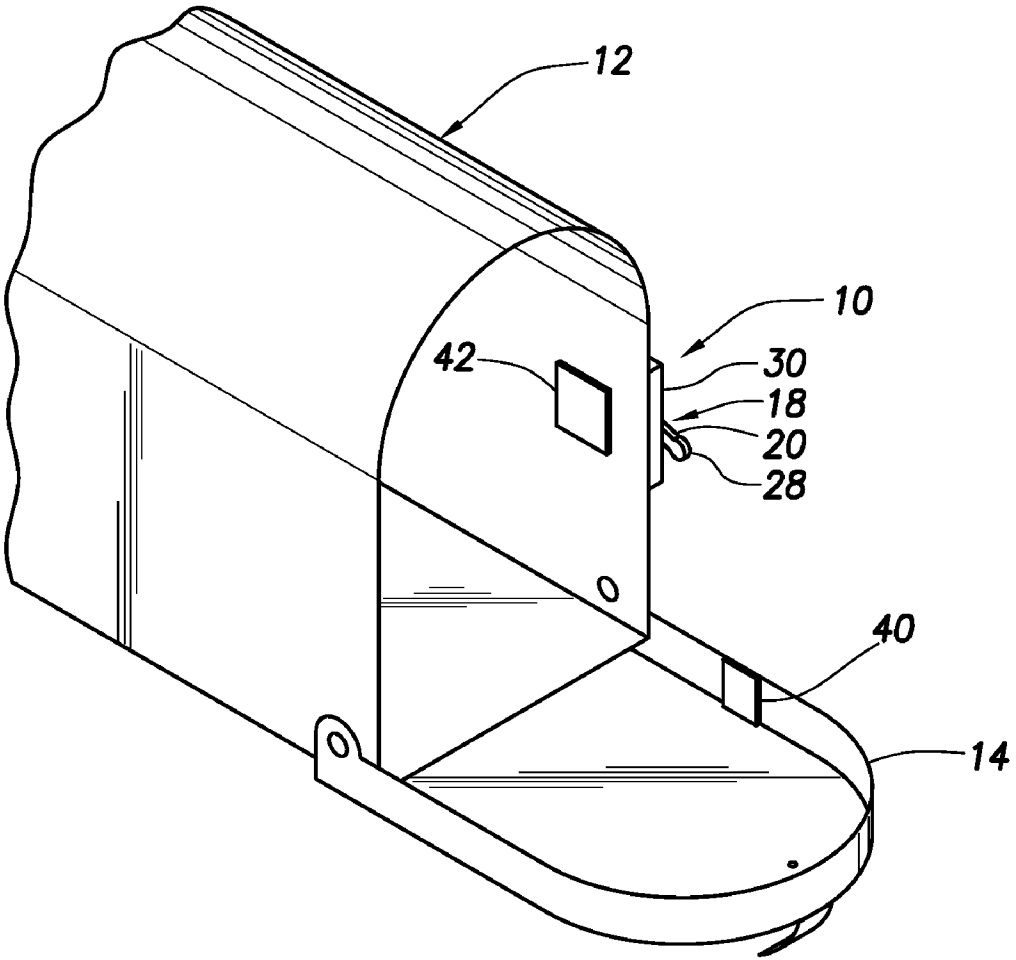
FIG. 10 is an isometric view of another configuration of the apparatus as used with a non-magnetic mailbox.

Alternatively, a small strip of magnetic material 42 (such as steel sheet metal, see FIG. 10) can be attached to the interior or exterior of the mail receptacle 16 (such as by using fasteners or double-sided adhesive tape, etc.). The base assembly 30 can then be attached to the mail receptacle 16 using the magnetic attraction between the magnet(s) 32 and the magnetic material 42 (as depicted in FIG. 10).

An additional magnet 38 can be attached to the interior of lid 22 or door 14 of the mailbox 12 (as depicted in FIGS. 8 & 9), for example, using a strip of double-sided adhesive. The magnet 28 at the end of the indicator arm 20 may magnetically couple with the magnet 38 in the door 14 or lid 22, thus resulting in a magnetic coupling between the indicator arm 20 and the door or lid.

Alternatively, a small strip of magnetic material 40 (such as steel sheet metal, see FIG. 10) can be attached to the interior or exterior of the door 14 or lid 22 (such as by using fasteners or double-sided adhesive tape, etc.). The magnet 28 at the end of the indicator arm 20 may then magnetically couple with the magnetic material 40 using the magnetic attraction between the magnet 28 and the magnetic material (as depicted in FIG. 10).

In other configurations, the apparatus 10 may not only be used with a mailbox 12, but may be used in conjunction with other objects such as a refrigerator, a window, or an exterior or interior door. In these configurations, the apparatus 10 may be attached to the side, top or other surface of the object. The magnet 32 in the base assembly 30, or a base assembly having an alternate adhesive means for use with a non-magnetic surface, produces a magnetic coupling or adherence between the apparatus 10 and the object.

If the object is made of non-magnetic material, an additional magnet 38 may be attached to a door of the object, so as to provide a magnetic coupling with the magnet 28 located at the end of the indicator arm 20. As the door is opened, the magnetic coupling causes the indicator arm 20 to pivot from a first position to a second position, resulting in a visual indication of whether the object has been opened. Thus, it may be appreciated that many different configurations of the apparatus 10 are possible in keeping with the principles of the invention.

It may now be appreciated that the above description provides an apparatus 10 for use with a mailbox 12 having a door 14 pivotably attached to a mail receptacle 16. The apparatus 10 may include an indicator assembly 18 with an indicator arm 20 positionable in a first position when the door 14 is closed. A magnetic coupling between the door 14 and the indicator arm 20 is operative to displace the indicator arm 20 to a second position when the door 14 is opened.

The magnetic coupling may include a magnet 28, which holds the indicator arm 20 in the first position until the door 14 is opened, and causes the indicator arm 20 to displace to the second position when the door 14 is opened.

The magnet 28 may be positioned at a distal end of the indicator arm 20.

The indicator arm 20 may be made of magnetic material.

A base assembly 30 may be secured to the mail receptacle 16 and another magnetic coupling may occur between the base assembly 30 and the indicator arm 20.

Another magnet 32 may be included in the base assembly 30, and may provide an adhesive force between the base assembly 30 and the mail receptacle 16.

The second magnet 32 may be encased by a non-magnetic material.

An apparatus 10 may include an indicator assembly 18 with an indicator arm 20 positionable in one position when the door 14 is closed and in another position when the door 14 is opened, and a magnet 28 which holds the indicator arm 20 in the first position until the door 14 is opened, and which causes the indicator arm 20 to displace to the second position when the door 14 is opened.

The apparatus 10 may include a magnetic coupling between the door 14 and the indicator arm 20, the magnetic coupling being operative to displace the indicator arm 20 to the second position when the door 14 is opened.

The magnet 28 may be positioned at a distal end of the indicator arm 20.

The indicator arm 20 may be made of magnetic material.

A base assembly 30 may be secured to the mail receptacle 16 and another magnetic coupling may occur between the base assembly 30 and the indicator arm 20.

The apparatus 10 may include an additional magnet 32 included in the base assembly 30, and which may provide an adhesive force between the base assembly 30 and the mail receptacle 16.

The additional magnet 32 may be encased by a non-magnetic material.

An apparatus 10 may include a base assembly 30 securable to the mail receptacle 16 having an indicator assembly 18 pivotably attached to the base assembly 30 and including an indicator arm 20. A magnetic coupling may occur between the base assembly 30 and the indicator arm 20.

The magnet 32 included in the base assembly 30 may provide an adhesive force between the base assembly 30 and the mail receptacle 16.

A non-magnetic material may encase the magnet 32.

The apparatus 10 may further include a magnetic coupling between the door 14 and the indicator arm 20, which may displace the indicator arm 20 to a second position when the door 14 is opened.

The apparatus 10 may include a magnet 28, which holds the indicator arm 20 in a first position until the door 14 is opened, and which may cause the indicator arm 20 to displace to the second position when the door 14 is opened.

The indicator arm 20 may be made of magnetic material.

Of course, a person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention. Accordingly, the foregoing detailed description is to be clearly understood as being given by way of illustration and example only, the spirit and scope of the present invention being limited solely by the appended claims and their equivalents.

What is claimed is:

1. Apparatus for use with a mailbox having a door pivotably attached to a mail receptacle, the apparatus comprising:

an indicator assembly including an indicator arm positionable in a first position when the door is closed;

a first magnetic coupling between the door and the indicator arm, the first magnetic coupling being operative to displace the indicator arm to a second position when the door is opened; and a base assembly securable to the mail receptacle, and wherein a second magnetic coupling occurs between the base assembly and the indicator arm.

2. Apparatus for use with a mailbox having a door pivotably attached to a mail receptacle, the apparatus comprising:

an indicator assembly including an indicator arm positionable in a first position when the door is closed and in a second position when the door is opened;

a first magnet which holds the indicator arm in the first position via a first magnetic coupling until the door is opened, and which causes the indicator arm to displace to the second position when the door is opened; and a base assembly securable to the mail receptacle, and wherein a second magnetic coupling occurs between the base assembly and the indicator arm.

3. The apparatus of claim 2, wherein the second magnetic coupling includes a second magnet in the base assembly, and wherein the second magnet provides an adhesive force between the base assembly and the mail receptacle.

4. The apparatus of claim 3, wherein the second magnet is encased by a non-magnetic material.

5. Apparatus for use with a mailbox having a door pivotably attached to a mail receptacle, the apparatus comprising:

a base assembly securable to the mail receptacle;

an indicator assembly pivotably attached to the base assembly and including an indicator arm; and a first magnetic coupling between the base assembly and the indicator arm, wherein the first magnetic coupling includes a magnet in the base assembly, and wherein the magnet provides an adhesive force between the base assembly and the mail receptacle.

6. The apparatus of claim 5, wherein the magnet is encased by a non-magnetic material.

7. Apparatus for use with a mailbox having a door pivotably attached to a mail receptacle, the apparatus comprising:

a base assembly securable to the mail receptacle;

an indicator assembly pivotably attached to the base assembly and including an indicator arm;

a first magnetic coupling between the base assembly and the indicator arm; and a second magnetic coupling between the door and the indicator arm, the second magnetic coupling being operative to displace the indicator arm to a second position when the door is opened.

8. The apparatus of claim 7, wherein the second magnetic coupling includes a magnet which holds the indicator arm in a first position until the door is opened, and which causes the indicator arm to displace to the second position when the door is opened.

* * * * *